US011261695B2

(12) United States Patent
Machocki

(10) Patent No.: US 11,261,695 B2
(45) Date of Patent: Mar. 1, 2022

(54) SYSTEMS AND METHODS TO REMOVE AND RE-APPLY SEALANT ON THE ANNULAR SIDE OF CASING

(71) Applicant: Saudi Arabian Oil Company, Dhahran (SA)

(72) Inventor: Krzysztof Karol Machocki, Aberdeenshire (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 1 day.

(21) Appl. No.: 16/902,090

(22) Filed: Jun. 15, 2020

(65) Prior Publication Data

US 2021/0388693 A1 Dec. 16, 2021

(51) Int. Cl.

| | |
|---|---|
| ***E21B 33/14*** | (2006.01) |
| ***E21B 29/02*** | (2006.01) |
| ***E21B 29/10*** | (2006.01) |
| ***E21B 33/12*** | (2006.01) |

(52) U.S. Cl.
CPC ..... *E21B 33/14* (2013.01); *E21B 29/02* (2013.01); *E21B 29/10* (2013.01); *E21B 33/1208* (2013.01)

(58) Field of Classification Search
CPC ..... E21B 33/14; E21B 29/10; E21B 33/1208; E21B 29/02; E21B 7/061
See application file for complete search history.

(56) References Cited

U.S. PATENT DOCUMENTS

| | | | | |
|---|---|---|---|---|
| 2,642,267 | A * | 6/1953 | Zublin | E21B 7/061 175/75 |
| 2,852,078 | A | 9/1958 | Krause, Jr. | |
| 3,380,534 | A | 4/1968 | Hall et al. | |
| 3,967,681 | A | 7/1976 | Curzon | |
| 4,158,388 | A | 6/1979 | Owen et al. | |
| 4,527,639 | A * | 7/1985 | Dickinson, III | E21B 7/061 166/50 |
| 4,531,583 | A | 7/1985 | Revett | |
| 4,538,684 | A | 9/1985 | Sheffield | |
| 7,621,327 | B2 | 11/2009 | Bane | |
| 7,640,983 | B2 | 1/2010 | Hilleary et al. | |

(Continued)

FOREIGN PATENT DOCUMENTS

| | | | |
|---|---|---|---|
| CA | 2238782 | C | 2/2003 |
| CN | 109083631 | A | 12/2018 |

(Continued)

OTHER PUBLICATIONS

International Search Report and Written Opinion for PCT Application No. PCT/US2021/037155 dated Sep. 22, 2021.

*Primary Examiner* — Michael R Wills, III

(74) *Attorney, Agent, or Firm* — Bracewell LLP; Constance G. Rhebergen; Linda L. Morgan

(57) ABSTRACT

Systems and methods for removing and replacing a first sealant in a subterranean well include a running sub located at an end of a running string. A helical guide port extends through the running sub. A port exit of the guide port is at a downhole end of the guide port and extends through a sidewall of the running sub. An inner assembly is extendable through the guide port. A head assembly is located at a drilling end of the inner assembly. The head assembly is sized to pass through the port exit and is oriented to drill a helical path within the first sealant radially exterior of the inner casing and form a void.

21 Claims, 7 Drawing Sheets

(56) References Cited

U.S. PATENT DOCUMENTS

| | | | | |
|---|---|---|---|---|
| 7,861,781 | B2 | 1/2011 | D'Arcy | |
| 8,424,620 | B2 * | 4/2013 | Perry, Jr | E21B 10/61 175/67 |
| 10,544,639 | B2 | 1/2020 | Sethurathinam et al. | |
| 2007/0125577 | A1 * | 6/2007 | Brunet | E21B 7/061 175/62 |
| 2009/0220303 | A1 | 9/2009 | Dickinson et al. | |
| 2013/0062125 | A1 * | 3/2013 | Savage | E21B 7/061 175/62 |
| 2013/0213716 | A1 * | 8/2013 | Perry | E21B 7/061 175/62 |
| 2014/0311741 | A1 * | 10/2014 | Tunget | E21B 41/00 166/285 |
| 2015/0198009 | A1 | 7/2015 | Bexte et al. | |
| 2015/0240573 | A1 * | 8/2015 | Jacobson | E21B 3/00 175/62 |
| 2018/0066489 | A1 | 3/2018 | Pipchuk et al. | |
| 2018/0245450 | A1 * | 8/2018 | Stokes | E21B 33/134 |
| 2018/0258735 | A1 | 9/2018 | Shafer | |
| 2018/0328118 | A1 | 11/2018 | Morse et al. | |

FOREIGN PATENT DOCUMENTS

| | | | |
|---|---|---|---|
| WO | 2015105427 | A2 | 7/2015 |
| WO | 2019013650 | A1 | 1/2019 |

* cited by examiner

SYSTEMS AND METHODS TO REMOVE AND RE-APPLY SEALANT ON THE ANNULAR SIDE OF CASING

BACKGROUND OF THE DISCLOSURE

1. Field of the Disclosure

The present disclosure relates to developing subterranean wells, and more particularly to repairing casing cement jobs of such subterranean wells.

2. Description of the Related Art

When developing a subterranean well, casing can be run and cemented in place. A function of the cement is to isolate the casing from the subterranean formation through which the subterranean well passes. In some hydrocarbon developments a cemented casing is placed across the entire depth of the subterranean formation.

If micro fractures and channels are present in the cement, the fluid or gas from lower sections of the subterranean well or from the formation can travel uphole to a more fragile section of the subterranean well or even to the surface between sections of casing. Such migration of fluid or gas can lead to a high pressure being applied to the more fragile sections of the well, in some occasions causing well stability problems, environmental problems, or underground blowouts.

SUMMARY OF THE DISCLOSURE

Embodiments of this disclosure can correct cement jobs that allow for fluid or gas migration through a permeable sealant. Systems and methods of the current application can remove and replace sections of permeable cement that surround a casing. A hole through the inner casing can be milled to provide access to the area radially outward of the inner casing. The sealant radially outward of the inner casing can be removed to form a void, and a replacement sealant can be delivered to and set within the void.

In an embodiment of this disclosure, a system for removing and replacing a first sealant in a subterranean well includes a running sub located at an end of a running string. A guide port extends through the running sub, the guide port being helical. The guide port further has a port exit at a port downhole end. The port extends through a sidewall of the running sub. An inner assembly is extendable through the guide port. A head assembly is located at a drilling end of the inner assembly. The head assembly is sized to pass through the port exit and is oriented to drill a helical path within the first sealant radially exterior to the inner casing, and form a void.

In alternate embodiments, the running string can have an inner bore and the inner assembly can extend through the inner bore of the running string. Alternately, an extension tool can be located between the running sub and the running string, and the inner assembly can be located within an internal passage of the extension tool. The extension tool can further include an actuation tool, the actuation tool operable to move the inner assembly in an axial direction within the extension tool.

In other alternate embodiments, the head assembly can include a driving assembly with a roller. The roller can be angled relative to a central axis of the driving assembly at an angle operable to direct the head assembly in a helical pattern through an annular space defined around an outer diameter of the inner casing. The head assembly can include a magnet positioned to attract the head assembly to the inner casing. A drilling head can be a part of the head assembly and can be operable to drill a hole through a sidewall of the inner casing.

In yet other alternate embodiments, the system can further include a cleaning assembly. The cleaning assembly can be part of the head assembly and can have jetting nozzles oriented to flush the first sealant from an annular space defined around an outer diameter of the inner casing. A cementing sub can have ports oriented to deliver a replacement sealant to the void. The subterranean well can have an outer barrier that circumscribes the inner casing. The helical path within the first sealant that is radially exterior to the inner casing can be radially interior of the outer barrier.

In an alternate embodiment of this disclosure, a system for removing and replacing a first sealant in a subterranean well includes a running sub located at an end downhole end of a running string extended into the subterranean well. A guide port extends through the running sub. The guide port has a helical path and has a port exit that extends through a sidewall of the running sub. The port exit has an exit opening on an outer diameter surface of the running sub that is oriented towards an inner casing of the subterranean well along a trajectory of the helical path An inner assembly is extendable through the guide port. A head assembly is located at a drilling end of the inner assembly. The head assembly is sized to pass through the port exit and is oriented to drill through an inner casing and into the first sealant that is radially exterior of the inner casing.

In alternate embodiments the guide port can be operable to direct the head assembly to drill through the inner casing along the trajectory that is helical.

In another alternate embodiment of this disclosure, a method for removing and replacing a first sealant in a subterranean well includes extending a running sub into the subterranean well with a running string. An inner assembly extends to a guide port extending through the running sub. The guide port is helical and has a port exit at a port downhole end. A head assembly is passed through the port exit, the head assembly being located at a drilling end of the inner assembly. A helical path is drilled within the first sealant that is radially exterior to the inner casing to form a void.

In alternate embodiments, the running string can have an inner bore and the method can include extending the inner assembly through the inner bore of the running string. Alternately, an extension tool can have an actuation tool and be located between the running sub and the running string. The method can further include locating the inner assembly within an internal passage of the extension tool and can move the inner assembly in an axial direction within the extension tool with the actuation tool.

In other alternate embodiment, the head assembly can include a driving assembly with a roller angled relative to a central axis of the driving assembly and the method can further include directing the head assembly in a helical pattern through an annular space defined around an outer diameter of the inner casing with the roller. The head assembly can be attracted to the inner casing with a magnet positioned on the head assembly. The head assembly can include a drilling head and the method can further include drilling a hole through a sidewall of the inner casing with the drilling head.

In yet other alternate embodiments, the first sealant can be flushed from an annular space defined around an outer diameter of the inner casing with jetting nozzles of a cleaning assembly that is part of the head assembly. A replacement sealant can be delivered to the void through ports of a cementing sub. The replacement sealant can be delivered to the void so that the replacement sealant fills the void and sets within the void. The subterranean well can have an outer barrier that circumscribes the inner casing, and drilling the helical path within the first sealant can include drilling the helical path within the first sealant that is radially exterior to the inner casing and is radially interior of the outer barrier. Alternately, the outer barrier can be a subterranean formation and the method can further include extending the helical path into the subterranean formation.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
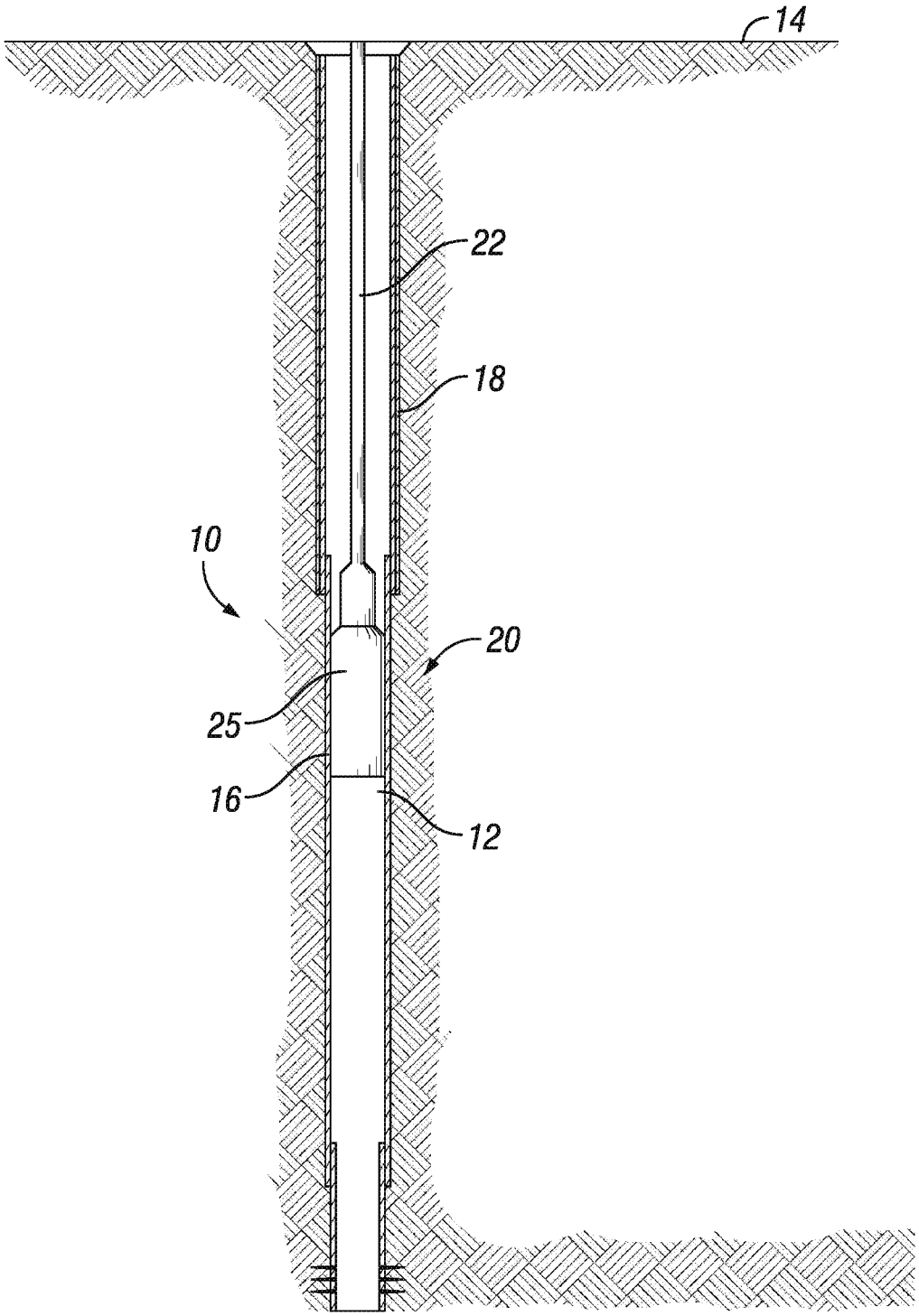
FIG. 1 is a section view of a subterranean well with a sealant replacement system, in accordance with an embodiment of this disclosure.

Looking at FIG. 1, subterranean well 10 can have wellbore 12 that extends to an earth's surface 14. Wellbore 12 can be drilled from surface 14 and into and through various formation zones of subterranean formations. Subterranean well 10 can be an offshore well or a land based well and can be used for producing hydrocarbons from subterranean hydrocarbon reservoirs. Alternately, subterranean well 10 can be a water well, injection well, disposal well, test well, observation well, or other known type of subterranean well.

When drilling subterranean well 10, casing 16 can be set at a predetermined depth and cemented with a sealant 18, such as cement or other known casing sealant, to isolate the formations drilled to that depth. Casing 16 ensures that continued drilling of wellbore 12 below casing 16 will not be impacted by the characteristics of any formations drilled in a previous part of subterranean well 10, which are isolated by casing 16. In some cementing jobs, micro fractures or channels are present in sealant 18. Sealant replacement system 20 can be used to remove and replace the sealant 18 that contains such fractures or channels.

Figure 2:
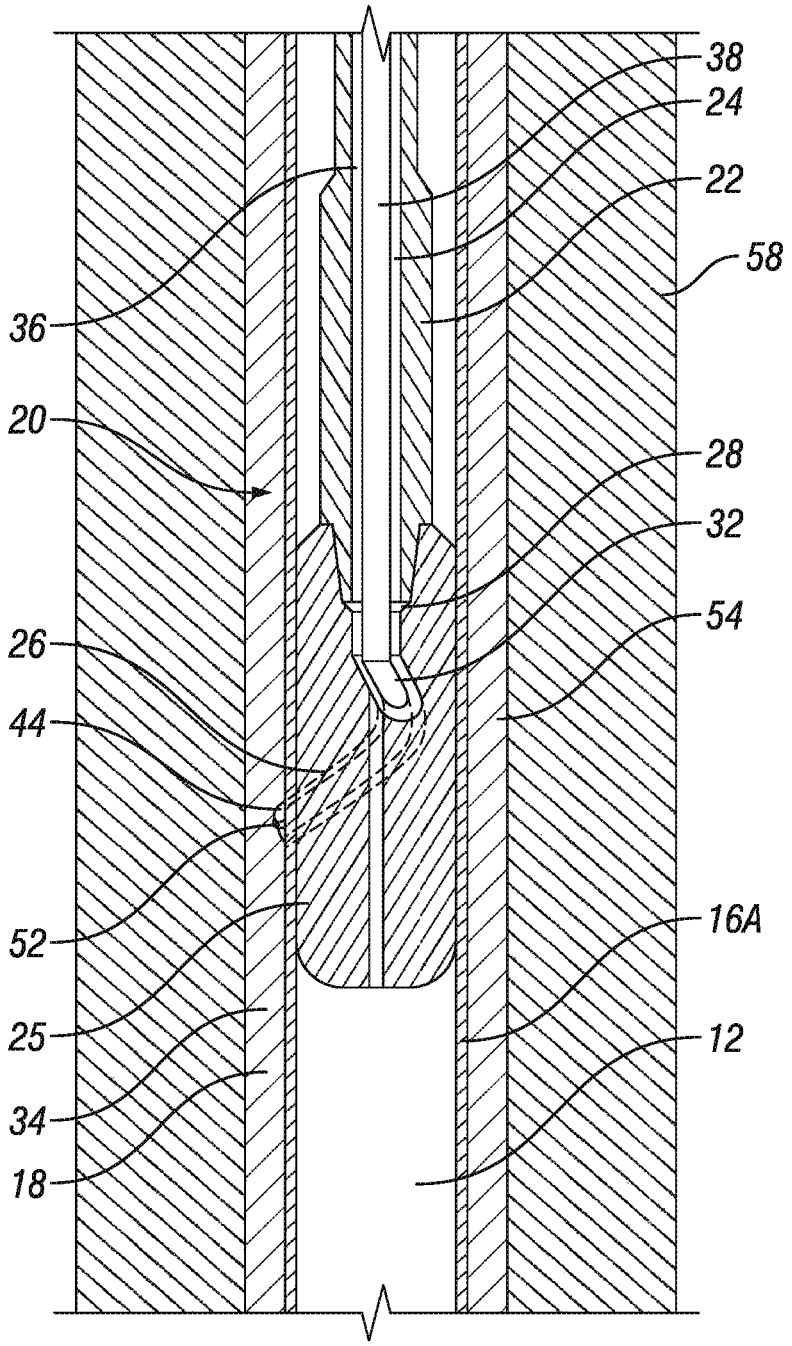
FIG. 2 is a detail section view of a subterranean well with a sealant replacement system, in accordance with an embodiment of this disclosure, shown with the inner assembly extended from the surface to within the running sub.
Figure 3:
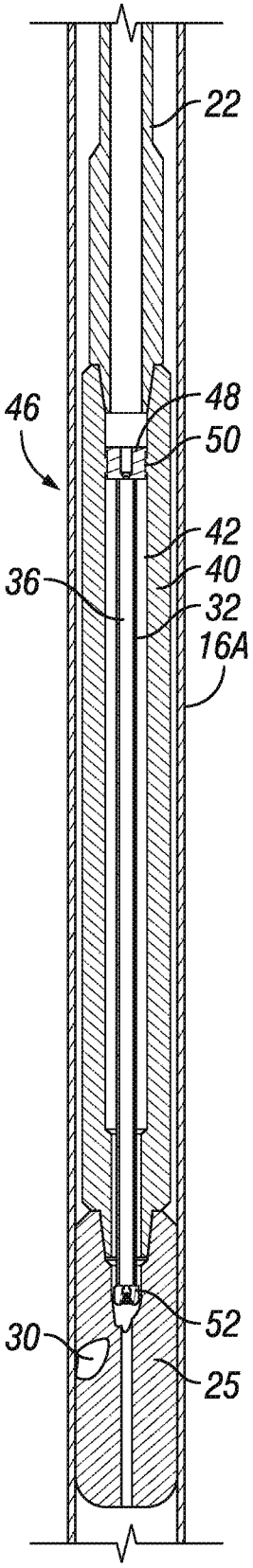
FIG. 3 is a section view of a subterranean well with a sealant replacement system, in accordance with an embodiment of this disclosure, shown with the inner assembly integrated within the running sub.

Looking at FIG. 1, sealant replacement system 20 can be run into wellbore 12 of subterranean well 10 on running string 22. Running string 22 can be, for example, a drill pipe or coil tubing (FIGS. 2-3). In alternate examples, running string 22 could be a cable such as an e-line or a slick line (FIG. 4).

Figure 4:
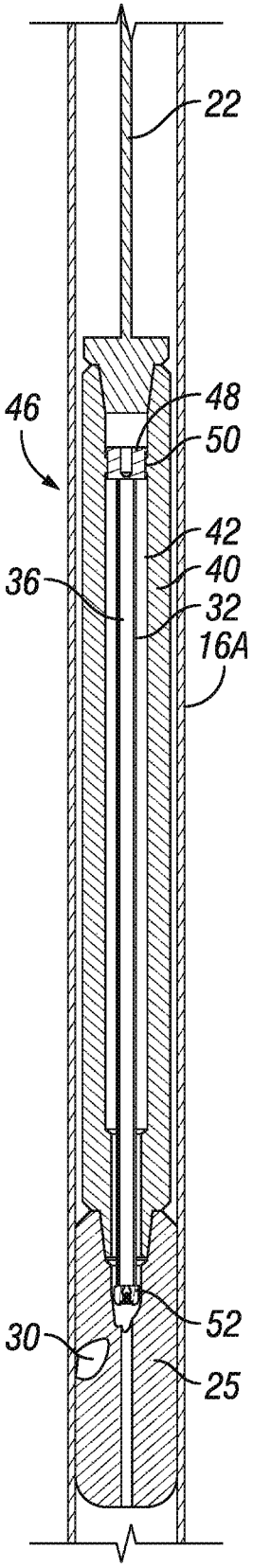
FIG. 4 is a section view of a subterranean well with a sealant replacement system, in accordance with an embodiment of this disclosure, shown with the inner assembly integrated within the running sub and with the running sub suspended from a cable.

Looking at FIGS. 2-4, running string 22 can include inner bore 24. Sealant replacement system 20 includes running sub 25. Running sub 25 is located at the downhole end of running string 22. Running sub 25 has a generally circular cross section. Running sub 25 includes guide port 26 that extends through running sub 25. In the embodiments of FIGS. 2-3, guide port 26 has a port uphole end 28 that is in communication with inner bore 24 of running string 22. In the embodiment of FIG. 4 where running string is a cable, running string 22 does not have an inner bore.

Guide port 26 has a port exit 30 that is at a port downhole end of guide port 26. Port exit 30 extends through a sidewall of running sub 25. Guide port 26 is helical in shape through running sub 25. Port exit 30 is oriented towards inner casing 16A of subterranean well 10. Port exit 30 has an exit opening on an outer diameter surface of running sub 25 that is oriented along a trajectory of the helical path of guide port 26.

Inner casing 16A is a casing that defines the bore through which running sub 25 is traveling. Guide port 26 and port exit 30 are shaped so that inner assembly 32 will be directed through guide port 26 and out port exit 30 at a desired angle to cut through inner casing 16A, and to allow inner assembly 32 to travel through annular space 34 defined around an outer diameter of inner casing 16A. In the embodiment of FIG. 2, annular space 34 is filled with sealant 18.

Inner assembly 32 can include inner assembly string 36. In the embodiment of FIG. 2, assembly string 36 can extend from the surface, through inner bore 24 of running string 22, and into running sub 25.

Figure 5:
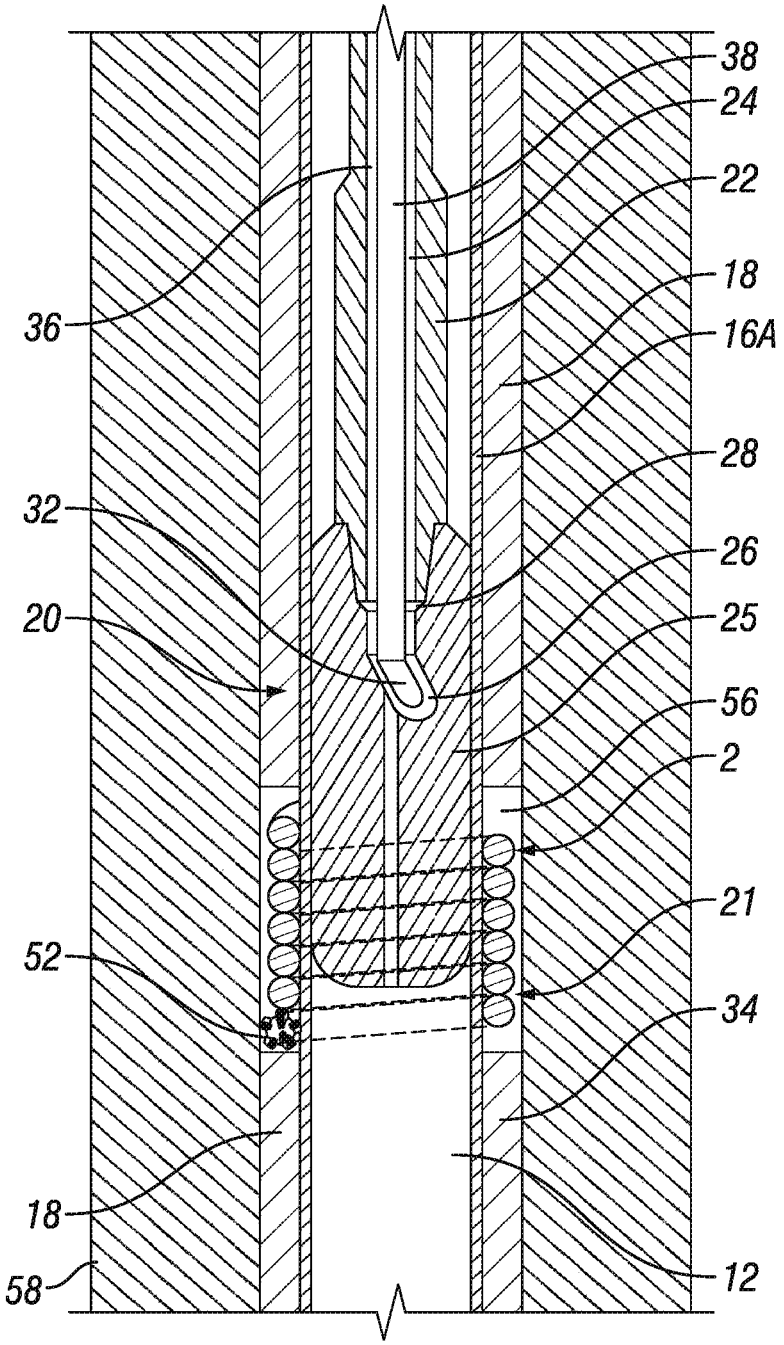
FIG. 5 is a detail section view of a subterranean well with a sealant replacement system, in accordance with an embodiment of this disclosure, shown with the head assembly within the first sealant radially exterior to the inner casing.

Looking at FIG. 5, a downhole portion of inner assembly string 36 can be flexible to allow for inner assembly 32 to form a helical shape in annular space 34. As an example, a downhole portion of inner assembly string 36 can be a jointed member or can be formed of a flexible material. Inner assembly string 36 can have a tool bore 38 that extends through inner assembly string 36. In certain embodiments, tool bore 38 can be used for the delivery of fluid downhole through sealant replacement system 20. As an example, looking at FIG. 6, tool bore 38 can be used to deliver jetting fluid or replacement sealant through sealant replacement system 20.

In alternate embodiments, running sub 25 can include a locking feature that will allow inner assembly 32 to be attached to running sub 25. Inner assembly 32 can then be detached when required. The attachment of inner assembly 32 to running sub 25 can be as an example, by shear pins, threaded members, actuated connectors, or other known attachment means that allow for the detaching of two assemblies as required.

Looking at FIGS. 3-4, sealant replacement system 20 can further include extension tool 40. Extension tool 40 can be located between running sub 25 and running string 22. In such embodiments, inner assembly 32 can be located within internal passage 42 of extension tool. Looking at FIGS. 3-4, sealant replacement system 20 can further include extension tool. Extension tool 40 can be located between running sub 25 and running string 22. In such embodiments, inner assembly 32 can be located within internal passage 42 of extension tool.

In the embodiments of FIGS. 3-4, assembly string 36 can be fully contained within internal passage 42 of extension tool 40 and guide port 26 of running sub 25. In such embodiments, assembly string 36 does not extend to the surface. Inner assembly 32 can be pre-loaded within extension tool 40 before running sub 25 is delivered into the wellbore. In alternate embodiments, extension tool 40 can be an integrated part of running sub 25 so that extension tool 40 and running sub 25 can be a single elongated member. In alternate embodiments, extension tool 40 can be an integrated part of running sub 25 so that extension tool 40 and running sub 25 can be a single elongated member.

Looking at FIGS. 2-4, inner assembly 32 can further include head assembly 44 located at a downhole or drilling end of inner assembly 32. Head assembly 44 is sized to pass through port exit 30. Head assembly 44 is located at a downhole end of inner assembly 32 and can include one or more tools and equipment. Movement mechanisms, such as pistons, electrical motor powered by batteries or through a cable to the surface, a threaded assembly that converts rotation to axial movement, or other known movement means can be used to move inner assembly 32 axially so that head assembly 44 can pass through port exit 30. The movement mechanism can provide movement of inner assembly 32 in an axially uphole direction, in an axially downhole direction, in a right hand rotational direction, in a left hand rotational direction, or in a combination of such directions. In embodiments where inner assembly 32 extends to the surface, such movement can be provided by moment mechanisms that are located at the surface.

Looking at the embodiments of FIGS. 3-4, when inner assembly 32 is located entirely within extension tool 40 and running sub 25, or entirely within running sub 25, actuation tool 46 can be used to move inner assembly 32 axially within internal passage 42 of extension tool. Actuation tool 46 can move inner assembly 32 in a direction downhole and in a direction uphole. As inner assembly 32 moves in a downhole direction, head assembly 44 can also move in a downhole direction and can travel through guide port 26, and out port exit 30. When inner assembly 32 is in an uphole position, as shown in FIGS. 3-4, head assembly 44 is located within running sub 25.

In the example embodiments of FIGS. 3-4, actuation tool 46 can include movement member 48 that is a piston member. The piston member can have a seal ring 50 that circumscribes the piston member and seals between an outer diameter surface of the piston member and an inner diameter surface of internal passage 42 of extension tool. Pressure applied to an uphole side of the piston member will move movement member 48 and inner assembly 32 in a downhole direction. Pressure applied to a downhole side of the piston member will move movement member 48 and inner assembly 32 in an uphole direction.

In alternate embodiments, movement member 48 of actuation tool 46 can include alternate types of movement mechanisms, such as electrical motor powered by batteries or through a cable to the surface, a threaded assembly that converts rotation to axial movement, or other known movement means. In embodiments, movement member 48 can provide movement of inner assembly 32 in an axially uphole direction, in an axially downhole direction, in a right hand rotational direction, in a left hand rotational direction, or in a combination of such directions.

In embodiments, the outer diameter surface of movement member 48 and the inner diameter surface of inner assembly 32 can both be smooth so that movement member 48 can move axially and rotationally within internal passage 42 freely. In alternate embodiments, movement member 48 can include a shape feature on the outer diameter surface of movement member 48 and the inner diameter surface of internal passage 42 can include a corresponding surface feature so that the travel of movement member 48 within internal passage 42 is guided by the shape feature. As an example, the shape feature of movement member 48 could be a rail and the shape feature of internal passage 42 could be a corresponding groove. In alternate embodiments, the surface features of movement member 48 and internal passage 42 can be a thread, such as an acme or trapezoidal thread.

Head assembly 44 includes drilling head 52. Drilling head 52 is oriented to drill a helical path within first sealant 54 that is radially exterior to inner casing 16A, and form a void 56, as shown in FIG. 5. First sealant 54 is a portion of sealant 18 that may contain fractures or channels and is therefore to be removed and replaced. Void 56 can extend axially along inner casing 16A a distance required to remove all of the underperforming first sealant 54. In an example embodiment, void 56 can have an axial height in a range of 1 inch to 30 feet. In alternate embodiments, void 56 can have an axial height greater than 30 feet.

The orientation of guide port 26, and port exit 30, as well as the flexibility of inner assembly string 36 allow for drilling head 52 to drill a hole through a sidewall of inner casing 16A and drill the helical path within first sealant 54 that is radially exterior to inner casing 16A without damaging outer barrier 58 that circumscribes inner casing 16A. The helical path within first sealant 54 is radially exterior to inner casing 16A and can be radially interior of outer barrier 58.

In certain embodiments, the same drilling head 52 can be used both to drill a hole through a sidewall of inner casing 16A and to drill the helical path within first sealant 54. In alternate embodiments, one drilling head 52 will be used to drill through inner casing 16A, and another drilling head 52 will be used to drill the helical path within first sealant 54. When a different drilling head is used to drill the helical path within first sealant 54, the drilling head 52 used to drill through inner casing 16A will be removed and replaced with the different drilling head 52 that is used to drill the helical path within first sealant 54.

In certain embodiments, outer barrier 58 can be an outer casing. In such an embodiment, drilling head 52 can form the helical path within first sealant 54 without damaging the outer casing. In other embodiments, outer barrier 58 can be a subterranean formation. In such an embodiment, drilling head 52 can form the helical path within first sealant 54 without damaging the subterranean formation. In certain embodiments where outer barrier 58 is a subterranean formation, drilling head 52 could remove a portion of the subterranean formation, such as up to 0.5 inches of subterranean formation, without damaging the subterranean formation. In such an embodiment, the removal of the portion of the subterranean formation will ensure that all compromised portions of first sealant 54 has been removed.

Figure 7:
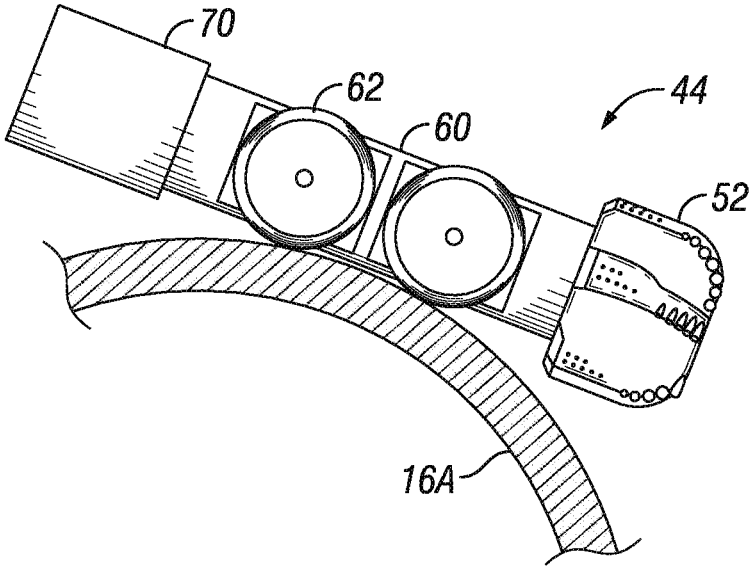
FIG. 7 is a perspective view of a head assembly, in accordance with an embodiment of this disclosure, shown radially exterior to the inner casing.
Figure 8:
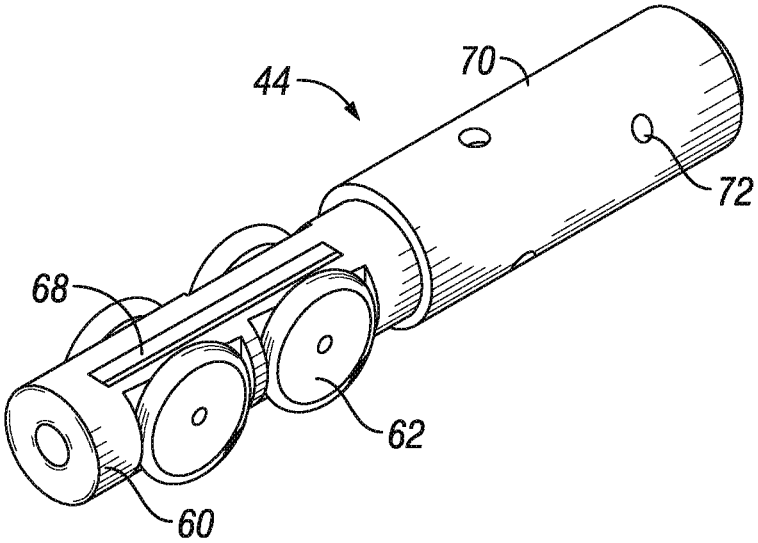
FIG. 8 is a perspective view of driving assembly of a head assembly, in accordance with an embodiment of this disclosure.
Figure 9:
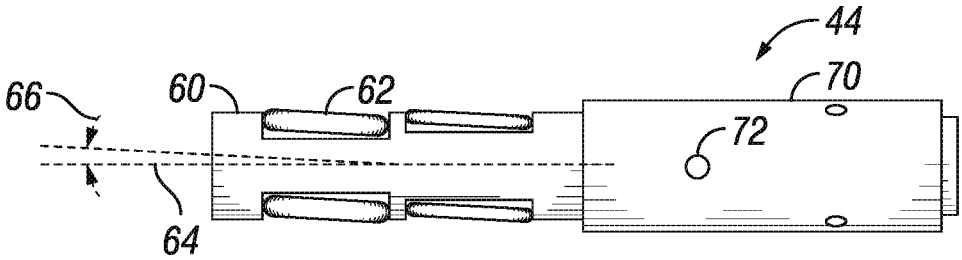
FIG. 9 is a top view of driving assembly of a head assembly, in accordance with an embodiment of this disclosure.

Looking at FIGS. 7-9, head assembly 44 can include features that will allow head assembly 44 to follow the outer diameter of inner casing 16A in tight helical patterns. In the example embodiment, such features include a driving assembly 60 with one or more rollers 62. Looking at FIG. 9, roller 62 can be angled relative to a central axis 64 of driving assembly 60 at an angle 66. Angle 66 is selected to direct head assembly 44 in a helical pattern through annular space 34.

Figure 10:
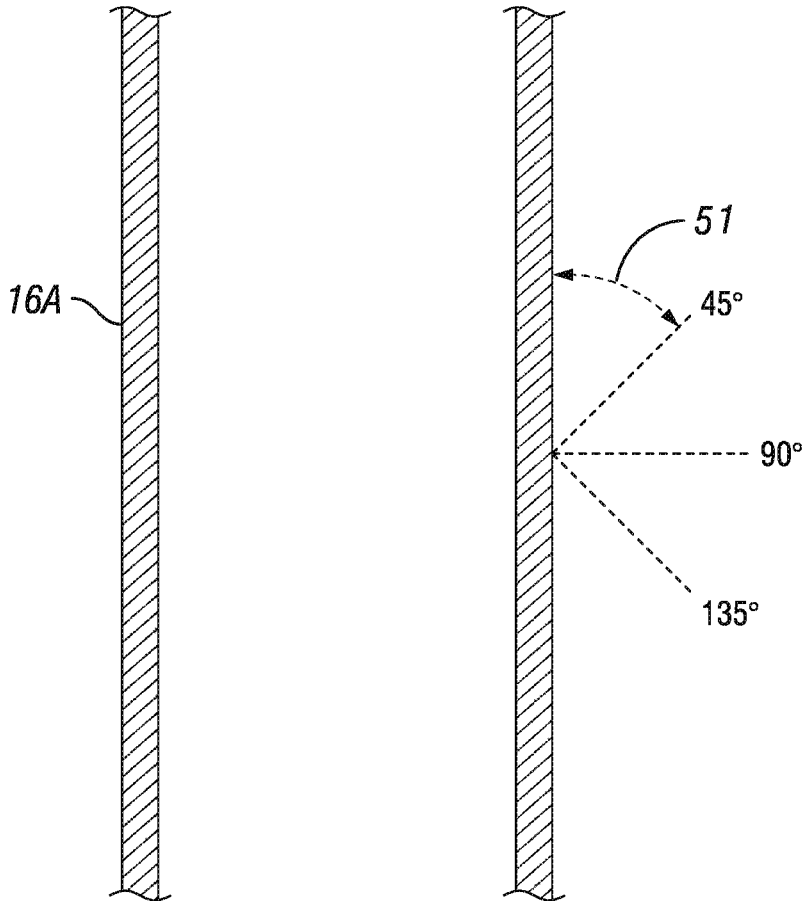
FIG. 10 is a schematic detail view of inner casing showing example drilling angles, in accordance with an embodiment of this disclosure.

The combination of the angle at which port exit 30 and exit opening of port exit 30 is oriented in relation to inner casing 16A, as well as angle 66 of roller 62 will be factors in determining the path of head assembly 44 through annular space 34. Looking at FIG. 10, exit angle 51 of port exit 30 can be in a range of 45 degrees to 135 degrees relative to the sidewall of casing 16A. An angle of 45 degrees would indicate that head assembly 44 would travel in an uphole direction. An angle of 135 degrees would indicate that head assembly 44 would travel in a downhole direction.

An angle of 90 degrees would indicate that head assembly 44 would travel circumferentially around inner casing 16A without traveling in an uphole or a downhole direction. In such an embodiment, head assembly 44 may not be able to travel completely around the entire circumference of inner casing 16A. For example, head assembly 44 may come into contact with inner assembly 32 before completely removing first sealant 54 around the circumference of inner casing 16A. In order to remove first sealant 54 around the entire circumference of inner casing 16A, head assembly 44 can be retracted back inside of running sub 25 and running sub 25 can be rotated. Head assembly 44 can then drill another hole through inner casing 16A at a different location at the same elevation and continue to remove first sealant 54 around the outer circumference of inner casing 16A. After removing first sealant 54 from completely around the circumference of inner casing 16A at such elevation, head assembly 44 can be retracted back inside of running sub 25 and running sub 25 can be moved axially to position head assembly 44 for removing first sealant 54 at an adjacent elevation for increasing the axial height of void 56.

In alternate examples, there may be no rollers and instead the feature that will allow head assembly 44 to follow the outer diameter of inner casing 16A in tight helical patterns is inner assembly string 36 itself. In such an embodiment, inner assembly string 36 can have a particular bending bias so that inner assembly string 36 can only bend in the direction required to follow the outer diameter of inner casing 16A in tight helical patterns.

Looking at FIG. 9, in order to assist head assembly 44 in maintaining contact with inner casing 16A, head assembly 44 can include magnet 68. Magnet 68 can be positioned on head assembly 44 so that magnet 68 causes head assembly 44 to be attracted to inner casing 16A.

Looking at FIGS. 8 and 9, head assembly 44 can further include cleaning assembly 70. Cleaning assembly 70 can include jetting nozzles 72 that are oriented to flush first sealant 54 from annular space 34. Cleaning assembly 70 can be actuated after cleaning assembly 70 has passed through inner casing 16A and entered first sealant 54. Cleaning assembly 70 can be positioned uphole of the drilling head 52. In alternate embodiments, cleaning assembly 70 can be used separately from drilling head 52. That is, head assembly 44 can include cleaning assembly 70 and not contain a drilling head 52. In such an embodiment, cleaning assembly 70 would be utilized after a separate drilling head 52 has performed the drilling operation.

The fluids that are jetted through jetting nozzles 72 can break up and remove first sealant 54 that has been drilled by drilling head 52, or that has been left behind between and around the helical pattern drilled by drilling head 52 in first sealant 54. The fluid jetted through jetting nozzles 72 can be delivered at a high velocity so that first sealant is broken up and washed away to the surface. In embodiments of this disclosure, a high velocity fluid jetted through jetting nozzles 72 can mean a velocity capable of eroding the material in front of the nozzle. As an example, a high velocity can be in a range of 30 m/s to 800 m/s.

In alternate embodiments, cleaning assembly 70 can utilize alternate methods of breaking up and flushing out first sealant 54. As an example, cleaning assembly 70 can instead utilize a mechanical force, a ream with sharp edges, or can apply a crushing or weakening force by applying radial expansion or vibrations. In other alternate embodiments, a combination of fluid jetting, mechanical forces, a ream, radial expansion, and vibrations can be used to break up and wash out first sealant 54.

Figure 6:
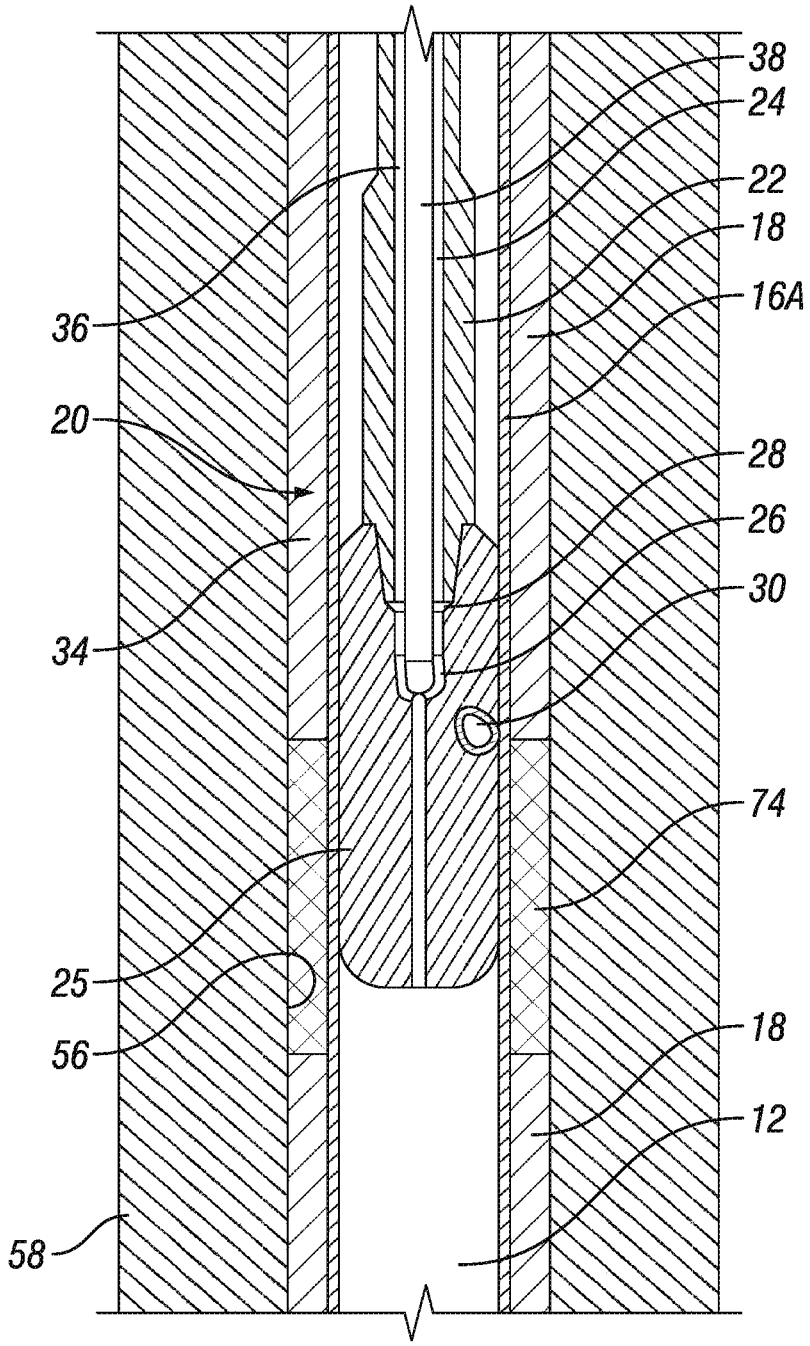
FIG. 6 is a detail section view of a subterranean well with a sealant replacement system, in accordance with an embodiment of this disclosure, shown with replacement sealant set radially exterior to the inner casing.

Head assembly 44 can further include a cementing sub. In the example embodiments of FIGS. 8-9, the cementing sub is cleaning assembly 70. In such an embodiment, jetting nozzles 72 can act as ports for delivering a replacement sealant 74 to void 56 (FIGS. 5-6). In alternate embodiments, the cementing sub can be separate from cleaning assembly 70.

Looking at FIG. 6, in embodiments, replacement sealant 74 can be delivered into void 56 through ports of a cementing sub so that replacement sealant 74 fills void 56. Replacement sealant 74 can set within void 56. Replacement sealant 74 can form a sealed boundary defined between sealant 18 that is axially adjacent both uphole and downhole to replacement sealant 74, and between inner casing 16A and outer barrier 58. Replacement sealant 74 can be, for example, a casing cement or other sealant such as a polymer, or a meltable material such as bismuth that can be controllably heated to change to a liquid state and then solidify once the temperature is reduced. In each case, replacement sealant 74 will be selected to provide an impermeable seal.

In an example of operation, looking at FIG. 1, sealant replacement system 20 is delivered into wellbore 12 of subterranean well 10 on running string 22. Running sub 25 is positioned at the depth of interest within wellbore 12. In some cases, the depth of interest is proximate to a centralized section of inner casing 16A, either uphole or downhole of the centralizer. In embodiments where the depth of interest is proximate to a centralizer, head assembly 44 is guided in a direction away from the centralizer. In this way head assembly 44 is not damaged through contacting the centralizer. Centralizers can be made of a metal and could deflect and damage head assembly 44. Drilling head 52 can be used to remove first sealant 54 between axially adjacent centralizers. In addition, a benefit of removing first sealant 54 proximate to a centralizer is that inner casing 16A will be concentric within wellbore 12 so that annular space 34 has a constant radial depth about the outer circumference of inner casing 16A. Therefore a correct single size of drilling head 52 can remove all of the first sealant 54 within annular space 34. If inner casing 16A is not concentric within wellbore 12, a larger drilling head 52 would be required to remove first sealant 54 within one segment of annular space 34 and a smaller drilling head 52 would be required to remove first sealant 54 within another segment of annular space 34.

Looking at FIG. 2, inner assembly string 36 can be ran inside inner bore 24 of running string 22. Alternately, inner assembly 32 can be integrated as part of running sub 25 and detached from running sub 25 when required. Drilling head 52 can then be actuated to drill through inner casing 16A. Actuation of drilling head 52 can be performed by providing a fluid flow or electrical power from the surface. Alternately, a tool can be powered by a stored energy such as batteries, and the actuation of drilling head 52 can be performed by the tool in response to a signal from the surface. In other alternate embodiments, a sensor can be located at the tool that will recognize location of the casing at the depth of interest and actuation will happen automatically.

Looking at FIG. 5, drilling head 52 is capable of drilling through the inner casing 16A. Guide port 26 and port exit 30 deflect inner assembly 32 so that inner assembly 32 is at an optimum angle to enter annular space 34 and drill the helical path within first sealant 54 that is radially exterior to inner casing 16A without damaging outer barrier 58. Drilling head 52 can be oriented to drill in a helical pattern either in an uphole direction or in a downhole direction. Drilling head 52 can purposefully avoid the centralizer, or can purposefully mill the centralizer.

Cleaning assembly 70 can then be used. Cleaning assembly 70 can be located uphole of drilling head 52 on head assembly 44. Alternately, drilling head 52 can be removed from head assembly 44 and cleaning assembly 70 can be added. Cleaning assembly 70 can include jetting nozzles 72 that will flush first sealant 54 from annular space 34. Cleaning assembly 70 can be used to clean any remaining first sealant 54 within annular space 34. In embodiments where outer barrier 58 is a subterranean formation, cleaning assembly 70 could remove a portion of the subterranean formation, such as up to 0.5 inches of subterranean formation to ensure that all compromised portions of first sealant 54 have been removed.

Actuation of cleaning assembly 70 can be performed by providing a fluid flow or electrical power from the surface. Alternately, a tool can be powered by a stored energy such as batteries, and the actuation of cleaning assembly 70 can be performed by the tool in response to a signal from the surface. In other alternate embodiments, a sensor can be located at the tool that will recognize location of the casing at the depth of interest and actuation of cleaning assembly 70 will happen automatically.

Looking at FIG. 5, after cleaning operations have been performed by cleaning assembly 70, replacement sealant 74 can be delivered into void 56. Replacement sealant 74 can be delivered through a cementing sub. The cementing sub can be cleaning assembly 70 or can be a separate assembly or tool.

In the example embodiments of FIGS. 8-9, the cementing sub is cleaning assembly 70. In such an embodiment, jetting nozzles 72 can act as ports for delivering a replacement sealant 74 to void 56 (FIGS. 5-6). In alternate embodiments, the cementing sub can be separate from cleaning assembly 70. Replacement sealant 74 can be delivered into void 56 through ports of a cementing sub so that replacement sealant 74 fills void 56. Replacement sealant 74 can set within void 56. Sealant replacement system 20 can be removed from wellbore 12 of subterranean well 10 with running string 22.

Embodiments of this disclosure therefore provide systems and methods for replacing cement or other casing sealant that has fractures or channels that could allow for fluid or gas migration. Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for removing and replacing a first sealant in a subterranean well, the system including:

a running sub located at an end of a running string;

a guide port extending through the running sub, the guide port being helical and having a port uphole end, and having a port exit at a port downhole end, where the port exit extends through a sidewall of the running sub;

an inner assembly extendable through the guide port;

an extension tool located between the running sub and the running string, where the inner assembly is located within an internal passage of the extension tool;

a head assembly located at a drilling end of the inner assembly; where the head assembly is sized to pass through the port exit and is oriented to drill a helical path within the first sealant radially exterior of an inner casing and form a void.

2. The system of claim 1, where the running string has an inner bore and the inner assembly extends through the inner bore of the running string.

3. The system of claim 1, where the extension tool further includes an actuation tool, the actuation tool operable to move the inner assembly in an axial direction within the extension tool.

4. The system of claim 1, where the head assembly includes a driving assembly with a roller, the roller being angled relative to a central axis of the driving assembly at an angle operable to direct the head assembly in a helical pattern through an annular space defined around an outer diameter of the inner casing.

5. The system of claim 1, where the head assembly includes a magnet positioned to attract the head assembly to the inner casing.

6. The system of claim 1, further including a drilling head, the drilling head being part of the head assembly and operable to drill a hole through a sidewall of the inner casing.

7. The system of claim 1, further including a cleaning assembly, the cleaning assembly being part of the head assembly and having jetting nozzles oriented to flush the first sealant from an annular space defined around an outer diameter of the inner casing.

8. The system of claim 1, further including a cementing sub, the cementing sub having ports oriented to deliver a replacement sealant to the void.

9. The system of claim 1, where the subterranean well has an outer barrier that circumscribes the inner casing, and the helical path within the first sealant that is radially exterior to the inner casing is radially interior of the outer barrier.

10. A system for removing and replacing a first sealant in a subterranean well, the system including:

a running sub located at a downhole end of a running string extended into the subterranean well;

a guide port extending through the running sub, the guide port having a helical path and having a port exit extends through a sidewall of the running sub, the port exit having an exit opening on an outer diameter surface of the running sub that is oriented towards an inner casing of the subterranean well along a trajectory of the helical path;

an inner assembly extendable through the guide port;

an extension tool located between the running sub and the running string, where the inner assembly is located within an internal passage of the extension tool;

a head assembly located at a drilling end of the inner assembly; where the head assembly is sized to pass through the port exit and is oriented to drill through the inner casing and into the first sealant that is radially exterior of the inner casing.

11. The system of claim 10, where the guide port is operable to direct the head assembly to drill through the inner casing along the trajectory that is helical.

12. A method for removing and replacing a first sealant in a subterranean well, the method including:

extending a running sub into the subterranean well with a running string;

extending an inner assembly through to a guide port extending through the running sub, the guide port being helical and having a port uphole end, and having a port exit at a port downhole end;

passing a head assembly through the port exit, the head assembly being located at a drilling end of the inner assembly; and drilling a helical path within the first sealant that is radially exterior of an inner casing to form a void;

where an extension tool having an actuation tool is located between the running sub and the running string, and the method further includes locating the inner assembly within an internal passage of the extension tool and moving the inner assembly in an axial direction within the extension tool with the actuation tool.

13. The method of claim 12, where the running string has an inner bore and the method includes extending the inner assembly through the inner bore of the running string.

14. The method of claim 12, where the head assembly includes a driving assembly with a roller angled relative to a central axis of the driving assembly and the method further includes directing the head assembly in a helical pattern through an annular space defined around an outer diameter of the inner casing with the roller.

15. The method of claim 12, further including attracting the head assembly to the inner casing with a magnet positioned on the head assembly.

16. The method of claim 12, where the head assembly includes a drilling head and the method further includes drilling a hole through a sidewall of the inner casing with the drilling head.

17. The method of claim 12, further including flushing the first sealant from an annular space defined around an outer diameter of the inner casing with jetting nozzles of a cleaning assembly that is part of the head assembly.

18. The method of claim 12, further including delivering a replacement sealant to the void through ports of a cementing sub.

19. The method of claim 18, further including delivering the replacement sealant to the void so that the replacement sealant fills the void and sets within the void.

20. The method of claim 12, where the subterranean well has an outer barrier that circumscribes the inner casing, and where drilling the helical path within the first sealant includes drilling the helical path within the first sealant that is radially exterior to the inner casing and is radially interior of the outer barrier.

21. The method of claim 20, where the outer barrier is a subterranean formation and the method further includes extending the helical path into the subterranean formation.

* * * * *